US011240581B2

(12) United States Patent
Sampei

(10) Patent No.: US 11,240,581 B2
(45) Date of Patent: Feb. 1, 2022

(54) EARPIECE AND EARPHONE USING THE SAME

(71) Applicant: Hideaki Sampei, Ota (JP)

(72) Inventor: Hideaki Sampei, Ota (JP)

( * ) Notice: Subject to any disclaimer, the term of this patent is extended or adjusted under 35 U.S.C. 154(b) by 0 days.

(21) Appl. No.: 16/964,481

(22) PCT Filed: Jan. 22, 2019

(86) PCT No.: PCT/JP2019/001851
§ 371 (c)(1),
(2) Date: Jul. 23, 2020

(87) PCT Pub. No.: WO2019/146590
PCT Pub. Date: Aug. 1, 2019

(65) Prior Publication Data

US 2021/0058694 A1 Feb. 25, 2021

(30) Foreign Application Priority Data

Jan. 23, 2018 (JP) ..... JP2018-008623

(51) Int. Cl.
*H04R 1/10* (2006.01)

(52) U.S. Cl.
CPC ..... *H04R 1/1016* (2013.01); *H04R 1/1091* (2013.01)

(58) Field of Classification Search
CPC ..... H04R 2460/09; H04R 2460/11; H04R 25/652; H04R 1/345; H04R 1/1016
See application file for complete search history.

(56) References Cited

U.S. PATENT DOCUMENTS 8,885,866 B2 * 11/2014 Sakaguchi ..... H04R 25/652 381/382
9,319,767 B2 * 4/2016 Sakaguchi ..... H04R 25/02
(Continued)

FOREIGN PATENT DOCUMENTS

JP 2010-157814 A 7/2010
JP 2012-244350 A 12/2012
(Continued)

OTHER PUBLICATIONS

International Search Report dated Apr. 9, 2019, issued in counterpart application No. PCT/JP2019/001851 (2 pages).

*Primary Examiner* — Ryan Robinson
(74) *Attorney, Agent, or Firm* — Westerman, Hattori, Daniels & Adrian, LLP

(57) ABSTRACT

In an earpiece 10 of the present invention, mainly, a plug section 15 is fitted into a sound channel space 13A of a central tube section 13, and the plug section 15 is formed with a sound channel long hole 15B penetrating in a longitudinal direction thereof and sound channel short holes 15G penetrating in lateral directions thereof. With this structure, a very small part of sound transmitted from a stem section 12 is directly transmitted to the eardrum through an aperture 15A, but most of the sound transmitted from the stem section 12 is directly transmitted via an internal space 20 to the eardrum. Then, the user perceives the sound having detoured as indirect sound that comes from the front of himself/herself with a time difference, and thereby can feel out-of-head sound localization and sound spread, thereby experiencing a sense of direction from the front and realistic sensation.

18 Claims, 9 Drawing Sheets

(56) References Cited

U.S. PATENT DOCUMENTS

| | | | | |
|---|---|---|---|---|
| 10,972,829 | B2 * | 4/2021 | Yu | H04R 1/021 |
| 11,095,968 | B2 * | 8/2021 | Birch | H04R 1/1016 |
| 2010/0166245 | A1 | 7/2010 | Takigawa et al. | |
| 2013/0148830 | A1 | 6/2013 | Sakaguchi et al. | |
| 2014/0140565 | A1 * | 5/2014 | Liu | H04R 1/1091 381/380 |
| 2020/0145756 | A1 * | 5/2020 | Lin | H04R 1/1008 |
| 2021/0092536 | A1 * | 3/2021 | Roeck | H04R 25/48 |

FOREIGN PATENT DOCUMENTS

| | | | |
|---|---|---|---|
| JP | 5666797 | B2 | 2/2015 |
| JP | 6271795 | B1 | 1/2018 |
| WO | 2013/014852 | A1 | 1/2013 |

* cited by examiner

EARPIECE AND EARPHONE USING THE SAME

TECHNICAL FIELD

The present invention relates to earpieces each provided with a sound channel hole and cup holes and configured to cause sound generated by an earphone to reach the eardrum from the front side with a time difference, thereby achieving in-front localization and also enabling external sound to be heard, and relates to earphones using the same.

BACKGROUND ART

Since the spread of mobile phones, smartphones, and so on, the chances of listening to music, sound of interest, and the like have been more and more increasing, and many earphones and headphones have been developed depending on purposes. The chances of listening indoors and outdoors have been increasing, and the earphones and headphones are often used even during use of public transportation such as trains and buses and on other occasions.

Earphones, in particular, shut out ambient noise in order to improve the sound quality, and therefore makes it difficult to hear, for example, announcements in vehicles of public transportation, announcements in venues, and the like, which hinders danger prediction. Then, in order to eliminate the above-mentioned hindrance of danger prediction, there is a demand for earphones enabling listening to external sound while achieving high sound quality.

On the other hand, as seen in virtual reality (VR), even in the current situation where images are displayed in three dimensions (3D), earphones are usually used with in-head localization. Then, an improvement on the prevailing in-head localization described above is considered to enable sound listening with less discomfort in a VR device and realization of matching between 3D images and sound.

As a conventional earphone, a structure illustrated in FIG. 8 is known. FIG. 8 is a cross-sectional view for explaining the structure of an earphone 100.

As illustrated in FIG. 8, the earphone 100 mainly includes a front housing 101, a back housing 102, a cable housing 103, and a driver unit 104 arranged inside the above housings 101 to 103. Then, the front housing 101 is provided with a tubular first sound channel 105 as a sound outlet, and an earpiece 106 made of a silicone rubber or the like is attached to a distal end of the first sound channel 105. A sound channel attenuating material 107 is provided near the middle of the first sound channel 105 and attenuates the frequency range of a peak (around 6 kHz) caused by an ear canal occlusion effect.

The front housing 101 is provided with a second sound channel 108 through which a part of sound on the back side of the driver unit 104 is transmitted with a predetermined delay time as a spatially-reflected sound (reflected sound or reverberant sound) and is merged with sound (direct sound) passing into the first sound channel 105. Note that, the second sound channel 108 is provided with a reflected component attenuating material 109 for adjusting the phase and the sound pressure level of the reflected sound.

With the aforementioned structure, when sound generated by the driver unit 104 is outputted as direct sound from the first sound channel 105 toward the ear canal, the sound generated by the driver unit 104 is transmitted through the second sound channel 108 different from the first sound channel 105 and is merged with a delay into the direct sound in the first sound channel 105, so that the spatially reflected sound is artificially added to the direct sound from the driver unit 104. As a result, the earphone 100 alone can achieve out-of-head sound localization (in-front localization) without the need for a signal processing circuit in the driver unit 104 (see, for example, PLT 1).

Meanwhile, a structure illustrated in FIGS. 9A and 9B is known as a conventional canal type earphone. FIG. 9A is a cross-sectional view for explaining the structure of a conventional canal type earphone 120 (hereinafter referred to as the "earphone 120"). FIG. 9B is a top view of an earpiece 124 attached to the conventional earphone 120.

As illustrated in FIG. 9A, the earphone 120 mainly includes a driver 121, a housing 122 in which the driver 121 is housed, a tubular portion 123 protruding from the housing 122, and an earpiece 124 attached to a distal end of the tubular portion 123. Then, when the earphone 120 is worn in an ear, the earpiece 124 is inserted in an ear canal 125, and an outer circumferential portion of the earpiece 124 comes into close contact with an inner wall 126 of the ear canal 125 to prevent the earphone 120 from dropping down from the ear.

As illustrated in FIG. 9B, the earpiece 124 is provided with a sound channel hole 127 formed penetrating the center of the earpiece 124 and configured to transmit sound generated by the driver 121 to an eardrum. In addition, the earpiece 124 is provided with four through holes 128 formed around the sound channel hole 127. When the earphone 120 is worn in the ear, the through holes 128 allow the pressure inside the ear canal 125 occluded by the earpiece 124 to escape to the outside to reduce the feeling of pressure applied to the eardrum, and also guide external sound into the ear canal 125 to allow a user of the earphone 120 to hear the external sound (for example, see PLT 2).

CITATION LIST

Patent Literatures

[Patent Literature 1] Japanese Patent No. 5666797
[Patent Literature 2] Japanese Patent Application Publication No. 2012-244350

SUMMARY OF INVENTION

Technical Problems

As described above, in the earphone 100 illustrated in FIG. 8, the first sound channel 105 and the second sound channel 108 are formed in the front housing 101. Through the second sound channel 108, a part of sound on the back side of the driver unit 104 is transmitted with a predetermined delay time as spatially-reflected sound (reflected sound or reverberant sound) and is merged with sound (direct sound) passing into the first sound channel 105, so that the earphone 100 alone achieves out-of-head sound localization.

However, in the case where the first sound channel 105 and the second sound channel 108 are formed in the front housing 101 and other opening portions for generating opening ends and the like are formed in order to achieve the aforementioned out-of-head sound localization, the structure of the earphone 100 is so complicated that there is a problem of difficulty in reduction of manufacturing costs.

In addition, when the earphone 100 is worn in the ear, the ear canal is substantially occluded by the earpiece 106. Thus, for attenuating the frequency range of the peak (around 6 kHz) caused by the ear canal occlusion effect, the sound channel attenuating material 107 is provided near the middle of the first sound channel 105. Moreover, the second sound channel 108 is provided with the reflected component attenuating material 109 for adjusting the phase and the sound pressure level of the reflected sound. Therefore, not only the complicated structure of the earphone 100 but also an increase in the number of components causes the problem of difficulty in reduction of manufacturing costs.

Then, when the earphone 100 is worn in the ear, the ear canal is substantially occluded by the earpiece 106. For this reason, it is difficult to guide external sound into the ear canal and allow the user of the earphone 100 to hear the external sound. This poses a problem that the user may be hindered from predicting a danger in the surrounding environment.

On the other hand, in the case of the earphone 120 illustrated in FIGS. 9A and 9B, the structure of the earphone 120 is simple, and the four through holes 128 provided in the earpiece 124 are capable of guiding external sound into the ear canal 125 and thereby preventing the hindrance of user's prediction about a danger in the surrounding environment.

However, the structure in which the user listens to sound generated by the driver 121 directly from the sound channel hole 127 has a problem of being incapable of making an improvement on the prevailing in-head localization.

Further, the earpiece 124 has an open umbrella shape. When the earpiece 124 is worn in the ear, the center part of the distal end of the earpiece 124 is inserted in the inner side (eardrum side) of the ear canal 125. For this reason, although it depends on the insertion conditions by the user, the distal end side of the earpiece 124 usually tends to be in close contact with the inner wall 126 of the ear canal 125. Due to its structure, the distal end side of the earpiece 124 is not a free end, and is hardly deformed along the uneven structure of the inner wall 126 of the ear canal 125 when being inserted, so that a gap is likely to be formed between the earpiece 124 and the inner wall 126 of the ear canal 125. Thus, due to sound leakage or the like, there is a problem that it is difficult to achieve high sound quality.

The present invention has been made in view of the above circumstances, and intends to provide an earpiece provided with a sound channel hole and cup holes and thereby configured to achieve in-front localization by causing sound generated by an earphone to reach the eardrum from the front side with a time difference and also allow hearing of external sound, and provide an earphone using the earpiece.

Solution to Problems

An earpiece of the present invention is an earpiece detachably attached to a mount/demount groove of a stem section of an earphone, including a central tube section, one end side of which is attached to the stem section, and which internally includes a sound channel space; a cup section which is provided to surround the central tube section, one end side of which is formed integrally with the one end side of the central tube section, and the other end side of which is a free end; and a plug section, one end side of which is inserted in the sound channel space from the other end side of the central tube section. A sound channel hole through which the sound channel space and an internal space inside the cup section communicate with each other is formed in the central tube section. At least one cup hole through which the internal space and an external space outside the cup section communicate with each other is formed in the cup section near the stem section.

In the earpiece of the present invention, the plug section includes a sound channel long hole penetrating through inside of the plug section in a longitudinal direction thereof, and a sound channel short hole communicating with the sound channel long hole and formed in a lateral direction of the plug section. In a state where the plug section is inserted in the sound channel space, the sound channel hole, the sound channel long hole, and the sound channel short hole communicate with each other.

Moreover, in the earpiece of the present invention, the plug section is exposed from the other end side of the central tube section, an exposed portion of the plug section has a shape of a spherical body, and a width of an aperture formed by the sound channel long hole in the spherical body is narrower than a width of the sound channel long hole located inside the central tube section.

Further, the earpiece of the present invention further includes a cup hole adjuster plate arranged in abutment with an outer surface of the cup section. The cup hole adjuster plate includes a lock portion locked in the mount/demount groove, and a plate portion formed integrally with the lock portion and covering a portion of the outer surface at least including a region in which the plurality of cup holes are arranged. A cutout portion from which the plurality of cup holes are exposed is formed in the plate portion, and the cutout portion has a width enough to expose all the plurality of cup holes.

Furthermore, in the earpiece of the present invention, the number of the plurality of cup holes exposed from the cutout portion is adjustable by rotating one of the cup section and the cup hole adjuster plate relative to the stem section.

In addition, in the earpiece of the present invention, a portion of the other end side of the central tube section is formed as a lock protrusion which protrudes toward the sound channel space, an engagement portion that is engaged with the lock protrusion is formed on the outer surface of the plug section, and in a state where the plug section is inserted in the sound channel space, the engagement portion is located closer to the stem section than the lock protrusion is.

Additionally, an earphone of the present invention is an earphone to which the earpiece described above is attached, including: a diaphragm which vibrates according to an electric signal; a housing in which the diaphragm is arranged; and a stem section which is formed on one end side of the housing and to which the earpiece is attached. A side surface of the housing between the end of the housing on the other end side and the diaphragm is provided with at least one hole. In a state where the earphone is worn in an ear of a user, the hole in the housing and the cup hole in the earpiece face a tragus side of the ear of the user.

Still further, an earphone of the present invention is an earphone described above is attached, including: a diaphragm which vibrates according to an electric signal; a housing in which the diaphragm is arranged; and a stem section which is formed on one end side of the housing and to which the earpiece is attached. A plurality of holes are provided in and a slide ring which adjusts the number of the holes exposed on the side surface of the housing is arranged on the side surface of the housing between the end of the housing on the other end side and the diaphragm. In a state where the earphone is worn in an ear of a user, the holes in the housing and the cup hole in the earpiece face a tragus side of the ear of the user.

Advantageous Effects of Invention

In the earpiece of the present invention, sound transmitted from the stem section is transmitted through the plug section to the internal space between the central tube section and the cup section, and a part of the sound thus transmitted is released through the cup hole in the cup section to the external space of the earpiece once, and then is returned to the internal space. This structure enables the user to perceive the direct sound and the indirect sound together through the cup hole, and feel the out-of-head sound localization and sound spread, thereby experiencing a sense of direction from the front and realistic sensation.

In addition, in the earpiece of the present invention, the plug section attached to the central tube section includes the sound channel long hole penetrating through the inside of the plug section in the longitudinal direction thereof, and the sound channel short hole communicating with the sound channel long hole and penetrating in the lateral direction of the plug section. This structure causes a part of the sound transmitted from the stem section to be directly transmitted to the eardrum through the aperture formed by the sound channel long hole in the plug section, so that the user can experience the aforementioned sense of direction from the front and realistic sensation.

In addition, in the earpiece of the present invention, the width of the aperture formed by the sound channel long hole in the spherical body of the plug section is formed narrower than the width of the sound channel long hole. This structure causes most of the sound transmitted from the stem section to be transmitted through the internal space to the eardrum, and thereby the user can experience the aforementioned sense of direction from the front and realistic sensation.

Moreover, the earpiece of the present invention further includes the cup hole adjuster plate arranged in abutment with the outer surface of the cup section. The cutout portion from which the plurality of cup holes are exposed is formed in the plate portion of the cup hole adjuster plate. With this structure, the user can adjust the number of cup holes exposed from the cutout portion, and hear sound in the surrounding environment of the user, so that the user can predict a danger in the above surrounding environment.

Moreover, in the earpiece of the present invention, the user can adjust the number of cup holes exposed from the cutout portion easily by rotating any one of the cup section and the cup hole adjuster plate relative to the stem section.

Further, in the earpiece of the present invention, the lock protrusion that protrudes toward the sound channel space is formed on the other end side of the central tube section, and the engagement portion that is engaged with the lock protrusion is formed on the outer surface of the plug section. With this structure, before the plug section comes off from the central tube section, the lock protrusion of the central tube section gets stuck in the engagement portion of the plug section. As a result, the plug section is prevented from dropping off from the central tube section, and the plug section is prevented from remaining in the ear canal of the user.

In addition, in the earphone of the present invention, at least one hole is provided in the side surface of the housing between the end of the housing on the other end side of the earpiece main body and the diaphragm. In a state where the earphone is worn in the ear of the user, the hole in the housing and the cup holes in the earpiece face the tragus side of the ear of the user. This structure causes a part of sound released from the housing to be returned through the cup holes to the internal space of the earpiece, and therefore the user can experience the aforementioned sense of direction from the front and realistic sensation.

Additionally, in the earphone of the present invention, the plurality of holes penetrating through the inside of the housing are provided in and the slide ring which adjusts the number of holes exposed on the side surface of the housing is arranged on the side surface of the housing of the earpiece main body on the tragus side. This structure enables the user to adjust the number of cup holes exposed on the side surface of the earpiece on the tragus side and the number of holes exposed on the side surface of the housing as appropriate. Therefore, it is possible to adjust the intensity of the in-front localization and the excess or deficiency of the bass range caused by widening the range of external sound introduction.

DESCRIPTION OF EMBODIMENTS

Figure 1A:
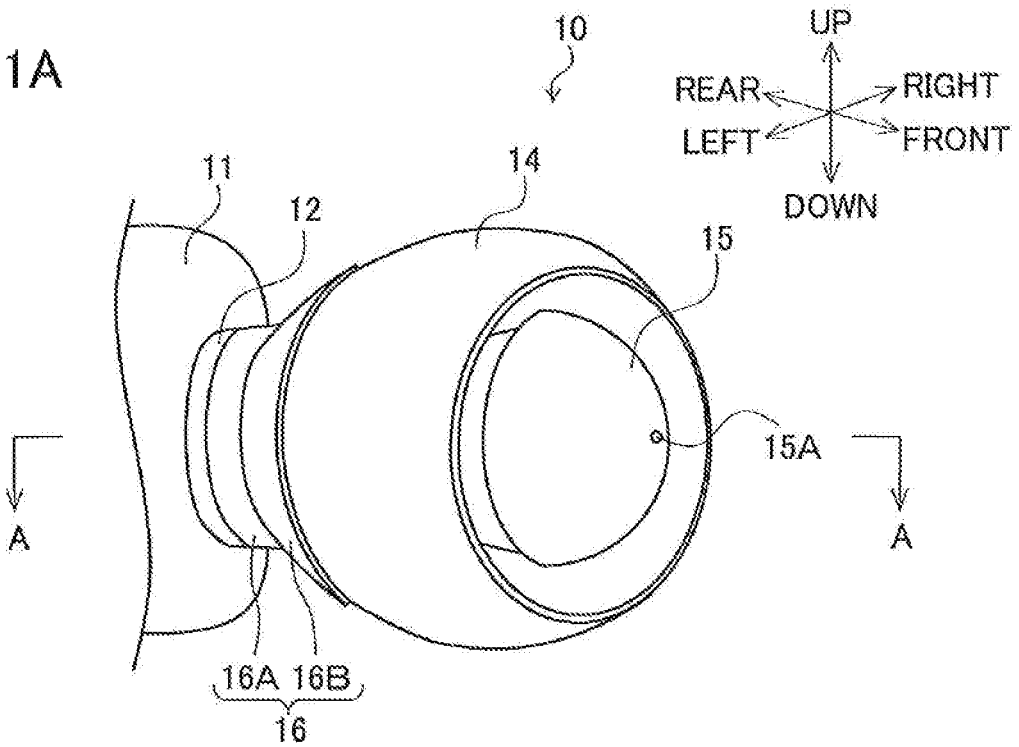
FIG. 1A is a perspective view and FIG. 1B is a perspective view for explaining an earpiece as an embodiment of the present invention.

Hereinafter, earpieces according to embodiments of the present invention will be described in detail based on the drawings. In the description of the embodiments, one and the same components will be denoted by the same reference numeral, and the repetitive description thereof will be omitted.

Figure 1B:
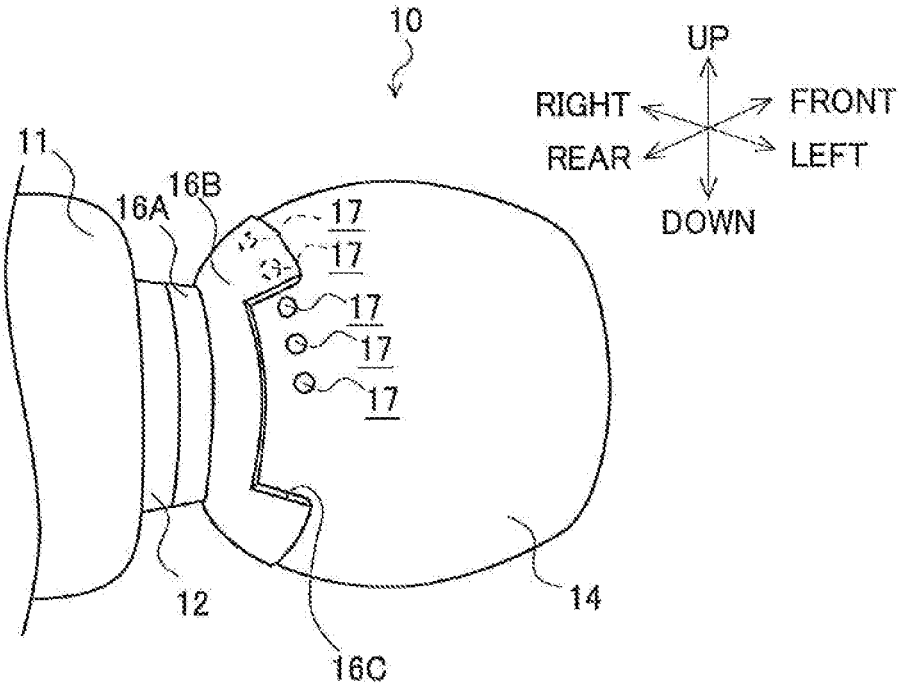
Figure 2A:
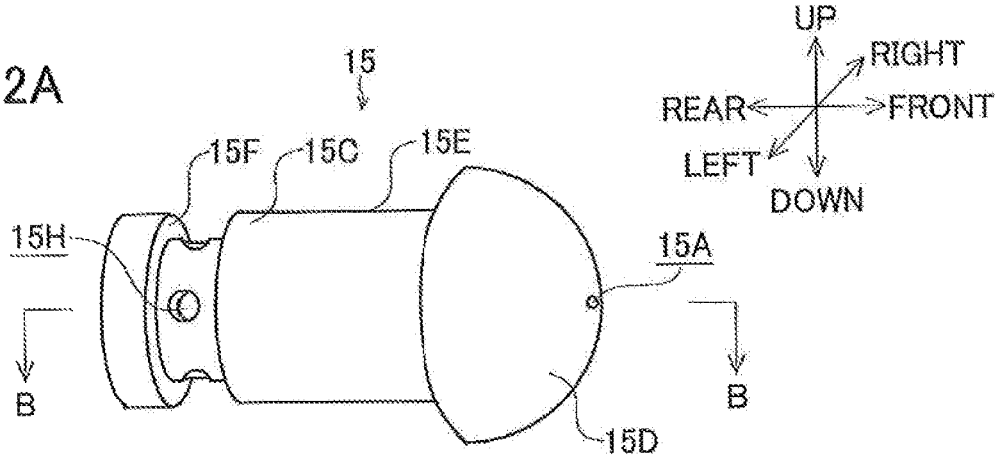
FIG. 2A is a perspective view.
Figure 2B:
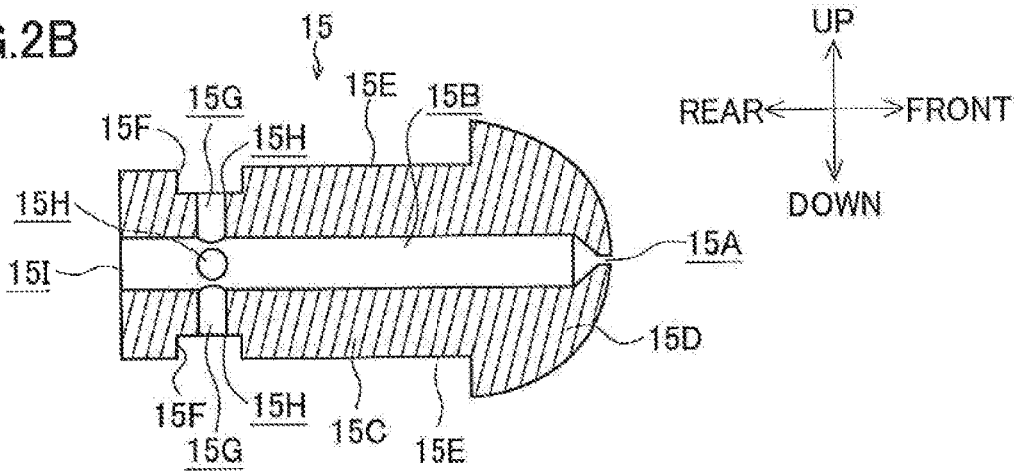
FIG. 2B is a cross-sectional view.
Figure 2C:
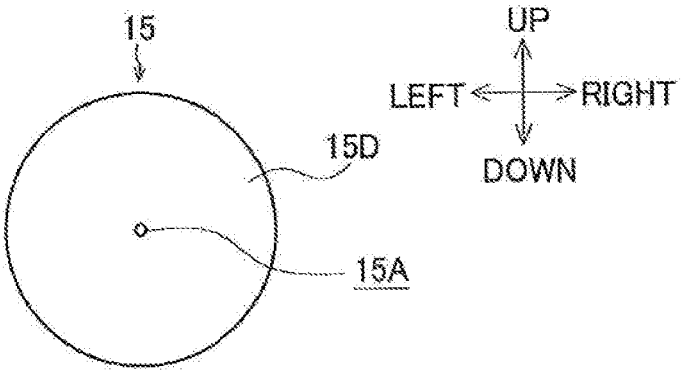
FIG. 2C is a top view.
Figure 2D:
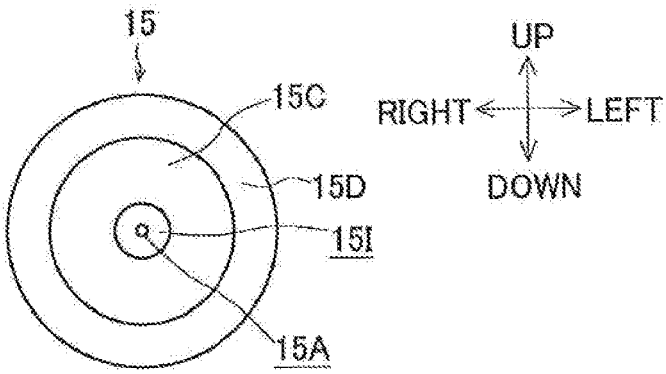
FIG. 2D is a bottom view for explaining the earpiece as the embodiment of the present invention.
Figure 3A:
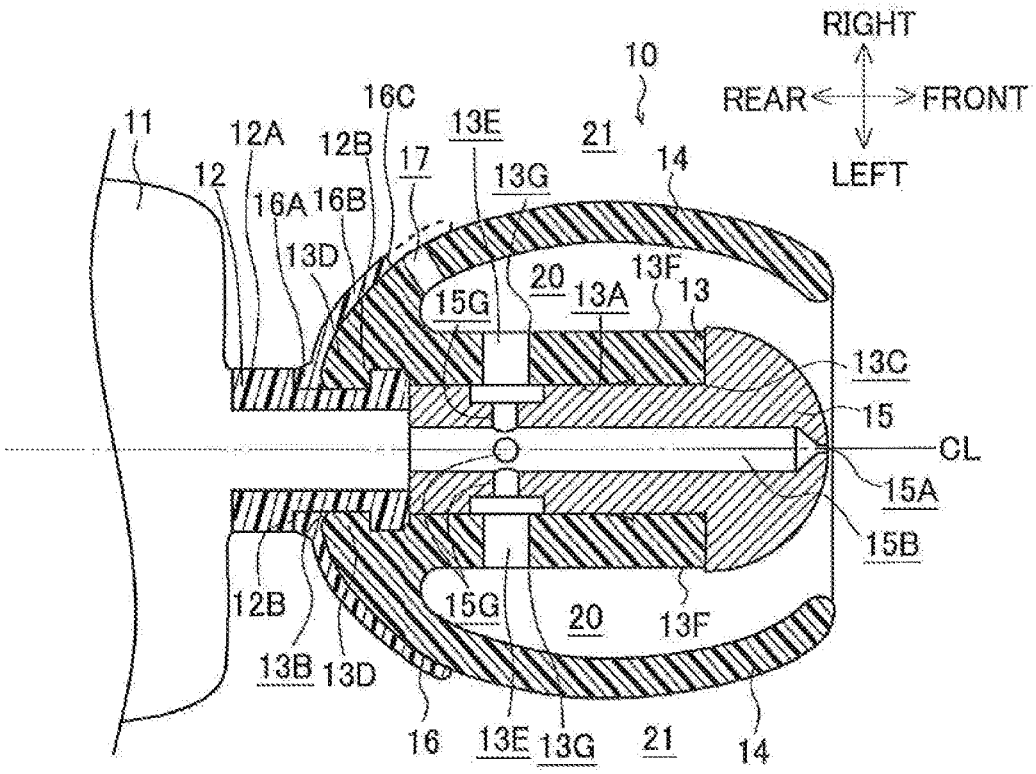
FIG. 3A is a cross-sectional view and FIG. 3B is a cross-sectional view for explaining the earpiece as the embodiment of the present invention.
Figure 3B:
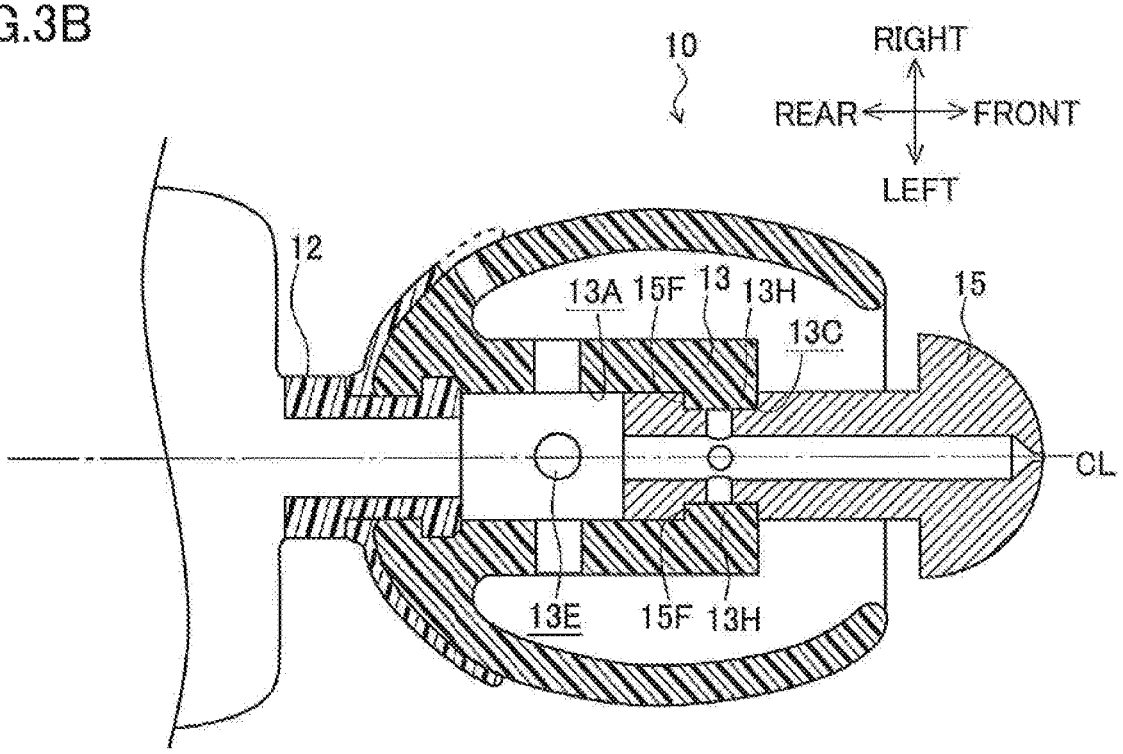

FIGS. 1A and 1B are perspective views illustrating an earpiece 10 of the present embodiment. FIG. 2A is a perspective view illustrating a plug section 15 of the earpiece 10 of the present embodiment. FIG. 2B is a view for explaining the plug section 15 of the earpiece 10 of the present embodiment and is a cross-sectional view taken along a B-B line direction in FIG. 2A. FIG. 2C is a top view of the plug section 15 of the earpiece 10 of the present embodiment when seen from the front end side. FIG. 2D is a bottom view of the plug section 15 of the earpiece 10 of the present embodiment when seen from the back end side. FIGS. 3A and 3B are views for explaining the earpiece 10 of the present embodiment and are cross-sectional views taken along an A-A line direction in FIG. 1A. Note that, in the description of FIGS. 1A to 3B, the front-back direction indicates a longitudinal direction of the earpiece 10, while the right-left direction and the top-bottom direction indicate lateral directions of the earpiece 10.

As illustrated in FIG. 1A, the earpiece 10 is detachably attached to a stem section 12 of an earphone 11 and configured with the intention to make an improvement on the in-head localization peculiar to the earphone 11 and change the in-head localization to the in-front localization. The earpiece 10 includes multiple components, and mainly includes a central tube section 13 (see FIG. 3A), a cup section 14 formed integrally with the central tube section 13, the plug section 15 detachably attached to the central tube section 13, and a cup hole adjuster plate 16 arranged in abutment with an outer circumferential surface of the cup section 14.

The central tube section 13 and the cup section 14 of the earpiece 10 are integrally formed of, for example, a rubber material having a hardness of A45 degrees to A50 degrees. As the above rubber material, for example, a silicone rubber is used. When the earpiece 10 is inserted in an ear canal 32 (see FIG. 5), the earpiece 10 is deformed appropriately according to the shape of an inner wall 34 (see FIG. 5) of the ear canal 32 to improve the close contact of the earpiece 10 with the inner wall 34 of the ear canal 32 and thereby to prevent unnecessary sound leakage from the ear. Although the details will be described later, the front end side of the cup section 14 of the earpiece 10 to be inserted into the inner side of the ear canal 32 is a free end, which allows the earpiece 10 to be more easily deformed according to the uneven shape of the inner wall 34, and thus improves the above-mentioned close contact.

The plug section 15 is detachably attached to the central tube section 13 formed inside the cup section 14. The plug section 15 is formed by processing a material having a specific gravity different from that of the silicone rubber, such as, for example, a surgical stainless steel, stainless steel, surgical titanium, silver, acrylic resin, natural material, or semi-precious stone. When the plug section 15 formed of the material having the different specific gravity is attached to the central tube section 13, the resonance frequency of the earpiece 10 due to sound is corrected, and the amount of noise generated by the resonance of the earpiece 10 is significantly reduced.

A sound channel long hole 15B (see FIG. 2B) penetrating in the longitudinal direction (the front-back direction in the drawing) is formed in the plug section 15, and an aperture 15A opened by the sound channel long hole 15B is formed in the center of a spherical portion 15D (see FIG. 2A) on the distal end side of the plug section 15. Then, a very small part of sound transmitted from the stem section 12 is transmitted directly into the ear canal 32 from the aperture 15A via the sound channel long hole 15B.

As illustrated in FIG. 1B, on one end side of the cup section 14, for example, five cup holes 17 are formed uniformly at regular intervals near the stem section 12. The cup holes 17 are holes through which the spaces inside and outside the cup section 14 communicate with each other, and are each formed with a size of Φ(diameter)0.1 mm to Φ2.0 mm. The five cup holes 17 are arranged in a region of about ⅓ of the circumference of the cup section 14. Here, the number of cup holes 17 may be changed in design as appropriate.

The cup hole adjuster plate 16 includes an annular lock portion 16A which is mounted on a mount/demount groove 12B (see FIG. 3A) provided to the stem section 12, and a cup-shaped plate portion 16B which is formed integrally with the lock portion 16A and abuts on the outer surface of the cup section 14. The cup hole adjuster plate 16 is formed of, for example, a silicone rubber that is the same material as the cup section 14 of the earpiece 10 described above. The hardness of the silicone rubber constituting the cup hole adjuster plate 16 may be changed in design as appropriate.

The plate portion 16B is arranged to cover the cup holes 17 formed in the cup section 14, and has a length of, for example, about 4.0 mm to 4.5 mm from the lock portion 16A. As illustrated in the drawings, the plate portion 16B is provided with a cutout portion 16C formed with such a width that the aforementioned five cup holes 17 can be exposed simultaneously. As described above, the cutout portion 16C has a width of about ⅓ of the circumference of the cup section 14 for the region where the cup holes 17 are arranged.

A lock portion 13D of the central tube section 13 (see FIG. 3A) is also mounted on the mount/demount groove 12B of the stem section 12, and the plate portion 16B of the cup hole adjuster plate 16 abuts on the outer circumferential surface of the cup section 14. When the earpiece 10 is used, the cup section 14 and the cup hole adjuster plate 16 are brought into close contact with each other and thereby are fixed due to the aforementioned abutment condition.

On the other hand, before using the earpiece 10, the user can, for example, pinch the cup section 14 to release the abutment condition of the cup section 14 and the cup hole adjuster plate 16 and rotate the cup section 14 relative to the stem section 12. This structure enables the user to adjust the number of cup holes 17 exposed from the cutout portion 16C of the cup hole adjuster plate 16. Although the details will be described later, an increase in the number of cup holes 17 exposed from the cutout portion 16C leads to an increase in the amount of indirect sound which reaches the eardrum with a time difference out of sound generated by the earphone 11, and thereby makes it easier to achieve the feeling of in-front localization. In addition, external sound easily reaches the eardrum through the cup holes 17, and therefore the user can easily predict a danger in the surrounding environment even when using the earpiece 10. Alternatively, after the cup section 14 is pinched to release the aforementioned abutment condition, the cup hole adjuster plate 16 may be rotated relative to the stem section 12.

As illustrated in FIG. 2A, the plug section 15 includes a cylindrical portion 15C in a substantially cylindrical shape extending in the front-back direction, and a spherical portion 15D of a spherical body formed integrally with a front end side of the cylindrical portion 15C. An engagement portion 15F in an annular recessed shape is formed on a back end side of an outer surface 15E of the cylindrical portion 15C. In the outer surface 15E of the engagement portion 15F, four apertures 15H opened by sound channel short holes 15G are formed.

As illustrated in FIG. 2B, in the plug section 15, the sound channel long hole 15B penetrating in the longitudinal direction (the up-down direction in the drawing) and the sound channel short holes 15G penetrating in the lateral directions (the right-left direction and the front-back direction in the drawing) are formed. A most portion of the sound channel long hole 15B is formed as a cylindrical hole with, for example, Φ2.0 to 2.5 mm, the hole width of the sound channel long hole 15B gradually narrows at a front end portion thereof, and the aperture 15A is formed with an aperture area of, for example, Φ0.3 to 1.0 mm.

In addition, the four sound channel short holes 15G are formed to be opened to the formation region of the engagement portion 15F. The four sound channel short holes 15G are formed at intervals of 90 degrees in the circumferential direction, and communicate with the sound channel long hole 15B at a center part of the plug section 15. The sound channel short holes 15G are formed as cylindrical holes with, for example, Φ1.0 to 1.5 mm, and the four apertures 15H are formed at intervals of 90 degrees in the outer surface 15E of the engagement portion 15F.

As illustrated in FIG. 2C, the aperture 15A opened by the sound channel long hole 15B is formed in the center of the front end of the spherical portion 15D. In addition, as illustrated in FIG. 2D, an aperture 15I opened by the sound channel long hole 15B is formed at the rear end of the cylindrical portion 15C.

As illustrated in FIG. 3A, the central tube section 13 is arranged at the center part of the earpiece 10 and is formed in a substantially cylindrical shape around a central axis line CL depicted by an alternate long and short dash line. Inside the central tube section 13, a sound channel space 13A penetrating in the longitudinal direction (the front-back direction in the drawing) is formed, and apertures 13B and 13C are formed at both ends of the central tube section 13. Then, the stem section 12 is inserted in the sound channel space 13A on the aperture 13B side of the central tube section 13, so that the earpiece 10 is attached to the earphone 11.

Here, the stem section 12 is formed in a substantially cylindrical shape around the central axis line CL as similar to the central tube section 13, and the mount/demount groove 12B in the annular recessed shape is formed in an outer surface 12A thereof. Then, an annular lock portion 13D protruding toward the sound channel space 13A is formed near the aperture 13B of the central tube section 13. When the earpiece 10 is attached to the earphone 11, the lock portion 13D gets stuck in the mount/demount groove 12B of the stem section 12, which establishes a structure in which the earpiece 10 is unlikely to come off from the stem section 12.

On the other hand, the plug section 15 is inserted in the sound channel space 13A on the aperture 13C side of the central tube section 13, and the sound channel space 13A is occluded by the plug section 15. As described above, the plug section 15 is provided with the sound channel long hole 15B formed along the longitudinal direction. With this structure, even when the aperture 13C of the central tube section 13 is occluded by the plug section 15, sound transmitted from the stem section 12 is transmitted to the sound channel long hole 15B of the plug section 15 inside the sound channel space 13A. Then, a very small part of the sound transmitted from the stem section 12 is transmitted to the inside of the ear canal 32 (see FIG. 5) directly through the aperture 15A of the sound channel long hole 15B.

Four sound channel holes 13E are formed in the lateral directions (the right-left direction and the front-back direction in the drawing) of the central tube section 13 at intervals of 90 degrees in the circumferential direction. The four sound channel holes 13E are each formed as a cylindrical hole communicating with the sound channel space 13A and having, for example, Φ1.0 to 1.5 mm. Then, in an outer surface 13F of the central tube section 13, four apertures 13G are formed by the four sound channel holes 13E at intervals of 90 degrees.

When the earpiece 10 is attached to the earphone 11, the back end of the plug section 15 abuts on the stem section 12 as illustrated in the drawings. In this state where the plug section 15 is inserted in the central tube section 13, the sound channel holes 13E of the central tube section 13 and the sound channel short holes 15G of the plug section 15 communicate with each other. With this structure, most of the sound transmitted from the stem section 12 is transmitted through the sound channel long hole 15B, the sound channel short holes 15G, and the sound channel holes 13E to an internal space 20 between the central tube section 13 and the cup section 14.

The cup section 14 is formed in such an umbrella shape as to surround the central tube section 13, and is formed to extend along the longitudinal direction of the central tube section 13. The one end side of the cup section 14 is formed integrally with the aperture 13B side of the central tube section 13, while the other end side of the cup section 14 is formed as a free end. Then, the cup section 14 is formed to extend beyond the central tube section 13, and the central tube section 13 is located inside the cup section 14. With this structure, the internal space 20 is formed between the cup section 14 and the central tube section 13.

As described above, on the one end side of the cup section 14, for example, the five cup holes 17 are formed uniformly at regular intervals near the stem section 12. The cup holes 17 are holes connecting the internal space 20 and an external space 21 outside the cup section 14.

In addition, the cup hole adjuster plate 16 is arranged outside the cup section 14, and the lock portion 16A of the cup hole adjuster plate 16 gets stuck in the mount/demount groove 12B of the stem section 12. That is, when the lock portion 13D of the central tube section 13 and the lock portion 16A of the cup hole adjuster plate 16 get stuck in the mount/demount groove 12B, the structure is established in which the earpiece 10 is unlikely to come off from the stem section 12.

In the plate portion 16B of the cup hole adjuster plate 16, the cutout portion 16C is formed with such a width that the aforementioned five cup holes 17 can be simultaneously exposed. The number of cup holes 17 exposed from the cutout portion 16C of the plate portion 16B can be adjusted within a range of 0 to 5.

Moreover, the spherical portion 15D of the plug section 15 is arranged to be exposed from the front end side of the central tube section 13. In this regard, the spherical portion 15D is desirably arranged not to protrude from the cup section 14 but to be located inside the cup section 14. With this structure, when the earpiece 10 is worn, the spherical portion 15D hardly comes into contact with the inner wall 34 of the ear canal 32 of the user, and the user is unlikely to feel unpleasant due to contact of the inner wall 34 with the spherical portion 15D.

As illustrated in FIG. 3B, the earpiece 10 is used in the state where the plug section 15 is inserted in the central tube section 13. An annular lock protrusion 13H protruding toward the sound channel space 13A is formed near the aperture 13C of the central tube section 13. Then, the shape of the lock protrusion 13H is a shape that can get stuck in the engagement portion 15F of the plug section 15. Note that, as illustrated in FIG. 3A, in the state where the plug section 15 is entirely inserted in the central tube section 13, the central tube section 13 slightly warps outward due to the thickness of the lock protrusion 13H.

With this structure, for example, even if the plug section 15 is pulled in a direction in which the plug section 15 may come off from the central tube section 13 in the process of removing the earpiece 10 from the ear canal 32 (see FIG. 5) of the user, the lock protrusion 13H of the central tube section 13 gets stuck in the engagement portion 15F of the plug section 15 before the plug section 15 comes off from the central tube section 13. As a result, the earpiece 10 can be removed from the ear canal 32 before the plug section 15 drops off from the central tube section 13, and this prevents the plug section 15 from remaining in the ear canal 32 of the user.

Figure 4:
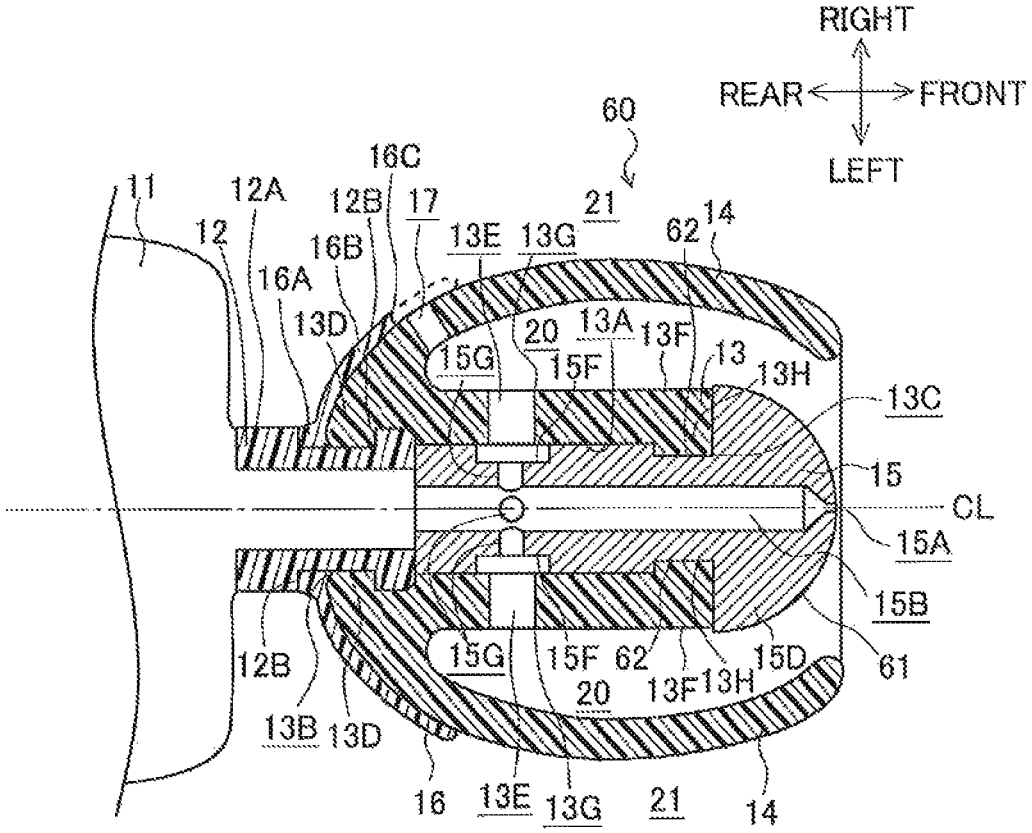
FIG. 4 is a cross-sectional view for explaining a modification example of the earpiece as the embodiment of the present invention.

Here, FIG. 4 is a cross-sectional view for explaining an earpiece 60 of the present embodiment, and illustrates a modification example of the earpiece 10 described by using FIGS. 1A to 3B. Here, the cross-sectional view in FIG. 4 corresponds to the cross-sectional view in FIG. 3A. The earpiece 60 in FIG. 4 has a structure different from the structure of the aforementioned earpiece 10 mainly in that an engagement portion 62 is formed in a plug section 61. For this reason, in the description of the earpiece 60 in FIG. 4, components different from those in the earpiece 10 described using FIGS. 1A to 3B will be mainly explained, and the explanation of the other components will be made by reference.

As illustrated in FIG. 4, the plug section 61 of the earpiece 60 is formed with two annular engagement portions 15F and 62 in the front-back direction of the plug section 61. The engagement portion 62 is located on a proximal end side of the outer surface 15D of the plug section 61 and is an annular recessed portion formed in the outer circumferential surface 15E of the cylindrical portion 15C.

As illustrated in the drawing, when the earpiece 60 is used, the plug section 61 is inserted in the central tube section 13 in the cup section 14. At this time, the lock protrusion 13H of the central tube section 13 gets stuck in the engagement portion 62 of the plug section 61, thereby establishing a structure in which the plug section 61 is unlikely to come off from the central tube section 13 in the cup section 14.

Further, for example, even if the lock protrusion 13H of the central tube section 13 comes off from the engagement portion 62 in the process of removing the earpiece 60 from the ear canal 32 (see FIG. 5), the lock protrusion 13H of the central tube section 13 gets stuck into the engagement portion 15F of the plug section 15 as described above by using FIG. 3B. In other words, the formation of the two annular engagement portions 15F and 62 in the plug section 61 in the front-back direction results in establishment of the structure in which the plug section 61 is unlikely to remain in the ear canal 32 of the user during use of the earpiece 60 or in the process of removing the earpiece 60 from the ear canal 32.

Figure 5:
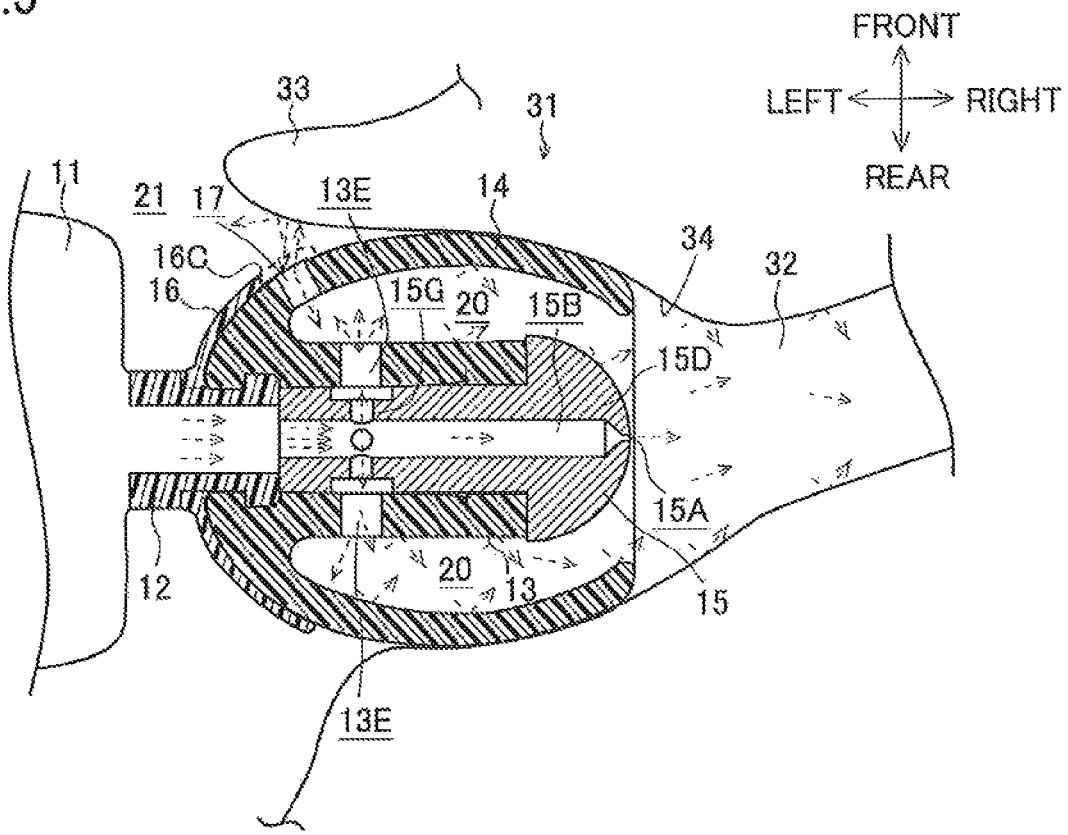
FIG. 5 is a cross-sectional view for explaining the earpiece as the embodiment of the present invention.

FIG. 5 is a perspective view for explaining a state where the earpiece 10 of the present embodiment is worn in the ear canal 32 of the user, and illustrates how sound is transmitted when the cup holes 17 are exposed from the cup hole adjuster plate 16. Here, in FIG. 5, a front-back direction indicates the front-back direction of the head of the user and a right-left direction indicates the right-left direction of the head of the user. Although the following description will be provided by using a left ear 31 of the user, the same applies to a right ear and the description for the right ear will be omitted herein.

FIG. 5 illustrates the state where the earpiece 10 is worn in the ear canal 32 of the left ear 31 of the user, and dotted arrows schematically depict sound transmission conditions. First, the earpiece 10 is inserted in the ear canal 32 such that the cup holes 17 of the cup section 14 face a tragus 33 outside the ear canal 32 of the left ear 31. In other words, the earpiece 10 is worn in the left ear 31 of the user such that a region where the cup holes 17 of the cup section 14 are formed faces the side in front of the head of the user.

The sound channel long hole 15B penetrates through the plug section 15 in the longitudinal direction. However, since the aperture area of the aperture 15A on the front end side is small, most of sound transmitted from the stem section 12 is transmitted through the sound channel long hole 15B, the sound channel short holes 15G, and the sound channel holes 13E to the internal space 20 between the central tube section 13 and the cup section 14. Here, a very small part of the sound transmitted from the stem section 12 is directly transmitted into the ear canal 32 through the aperture 15A of the plug section 15.

Most of the sound transmitted to the internal space 20 is transmitted toward the inside of the ear canal 32 while being reflected and diffused by the central tube section 13, the cup section 14, and so on around the internal space 20. On the other hand, a part of the sound transmitted to the internal space 20 is transmitted to the external space 21 through the cup holes 17. Then, most of the released sound is reflected by the tragus 33 and also its surroundings, for example, an uneven shape formed inside the left ear 31, and is transmitted to the internal space 20 again through the cup holes 17.

In other words, only a small part of the sound transmitted from the stem section 12 is directly transmitted to the eardrum through the aperture 15A, while the other most of the sound is transmitted to the internal space 20 of the earpiece 10. Then, the sound transmitted to the internal space 20 is transmitted toward the eardrum through the ear canal 32 while being diffused in the internal space 20 by the surface of the spherical portion 15D exposed from the central tube section 13, the inner wall 34 of the ear canal 32, and so on. At this time, a part of the sound transmitted to the internal space 20 is released to the external space 21 of the earpiece 10 once, and then is returned to the internal space 20 again. Thanks to these sound transmission conditions, the user can perceive the diffused sound as indirect sound coming from the front of the user with a time difference together with the direct sound through the aperture 15A, and feel the out-of-head sound localization and sound spread, thereby experiencing a sense of direction from the front and realistic sensation.

Moreover, since the cup holes 17 are exposed from the cutout portion 16C of the cup hole adjuster plate 16, sound in the surrounding environment of the user is transmitted into the internal space 20 through the cup holes 17 and then is transmitted to the eardrum through the ear canal 32. This structure allows the user to hear the sound in the surrounding environment of the user, for example, such as announcement sound inside a station while listening to the music or the like transmitted from the stem section 12 at a constant volume, and thereby predict a danger in the surrounding environment.

Next, an earphone according to another embodiment of this embodiment will be described in detail based on the drawings. Since the description of the present embodiment will be given by using the earpiece described above by using FIGS. 1A to 5, the same components will be denoted by the same reference numerals, and the repetitive description will be omitted.

Figure 6A:
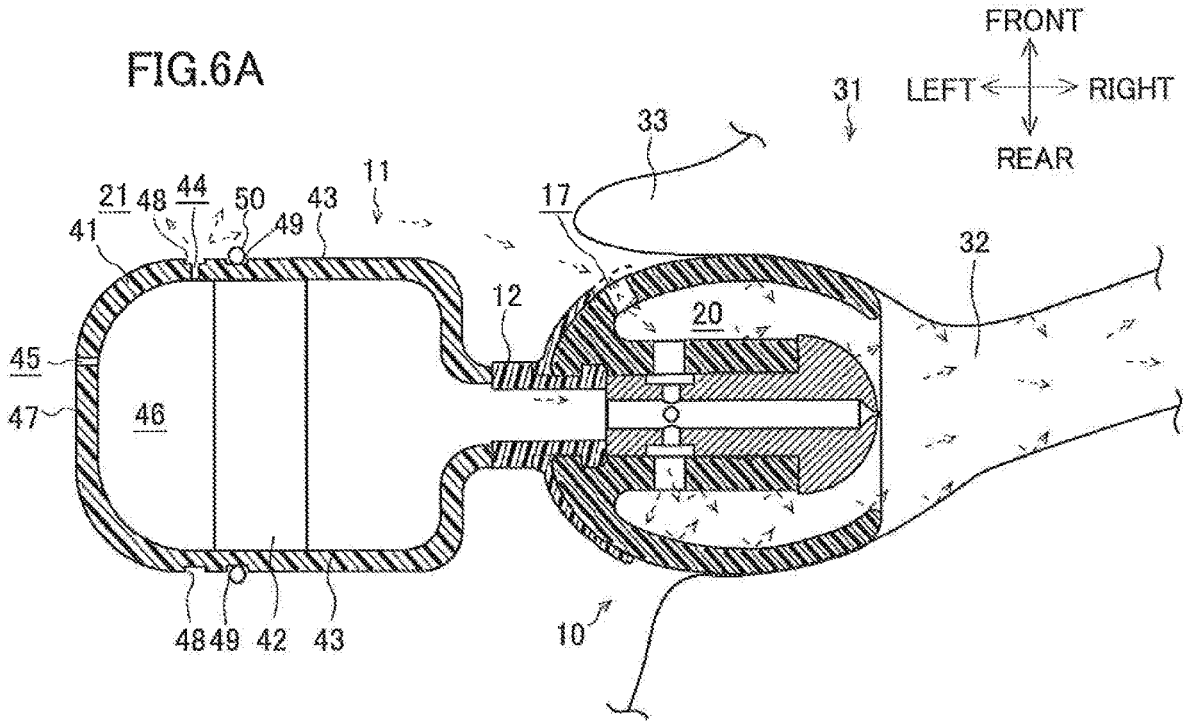
FIG. 6A is a cross-sectional view and FIG. 6B is a perspective view for explaining an earphone as another embodiment of the present invention.
Figure 6B:
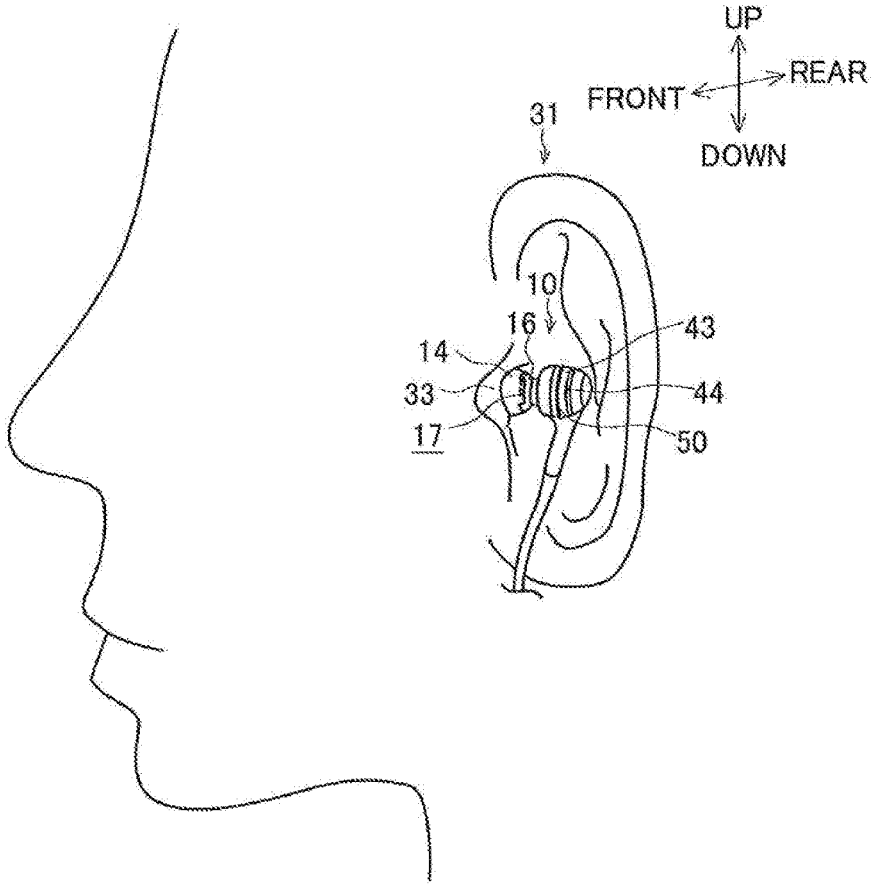

FIG. 6A is a cross-sectional view for explaining an earphone 11 of the present embodiment using the aforementioned earpiece 10. FIG. 6B is a perspective view for explaining the earphone 11 of the present embodiment using the aforementioned earpiece 10. Here, the earphone 11 will be described by referring to FIGS. 1A to 5 described above and the description thereof. Then, in FIGS. 6A and 6B, a front-back direction indicates the front-back direction of the head of the user and a right-left direction indicates the right-left direction of the head of the user. Although the following description will be provided by using a left ear 31 of the user, the same applies to a right ear and the description for the right ear will be omitted herein.

As illustrated in FIG. 6A, the earphone 11 is an insertion-type earphone worn and used in the ear canal 32 of the user, and mainly includes a housing 41 as a main body, a stem section 12 which is arranged on a distal end side of the housing 41 and to which the earpiece 10 is attached, and a driver unit 42 arranged inside the housing 41. The earphone 11 is used by connecting to a music terminal such as a portable music player, and music inputted to the earphone 11 from the music terminal causes a diaphragm (not illustrated) in the driver unit 42 to vibrate and create sound waves, which are then transmitted from the stem section 12.

In the present embodiment, the housing 41 is provided with at least one of holes 44 and 45. The holes 44 and 45 are holes through which an internal space 46 of the housing 41 and an external space 21 outside the housing 41 communicate with each other, and are formed in the housing 41 surrounding the internal space 46 between the driver unit 42 and a bottom surface 47 of the housing 41 on the side opposite from the stem section 12. In particular, the hole 44 is an inevitably-formed hole, and is formed in a side surface 43 between the driver unit 42 and the bottom surface 47 of the housing 41. Meanwhile, the hole 45 is formed in the bottom surface 47 of the housing 41 and releases the pressure in the internal space 46 when the diaphragm of the driver unit 42 vibrates. Then, a bass range of the music can be enhanced by widening the amplitude width of the diaphragm of the driver unit 42.

As illustrated in the drawings, two annular grooves 48 and 49 are formed in the side surface 43 of the housing 41, and annular rubber members, for example, O rings 50 are arranged in the grooves 48 and 49. When the O rings 50 are arranged on the side surface 43 of the housing 41, the user can use the O rings 50 as a slip stopper, and more easily pinch the housing 41 in the process of wearing the earpiece 10. In addition, the groove 48 is formed covering a region where the hole 44 is formed, and the O ring 50 is arranged in the groove 48. Thus, the hole 44 is closed by the O ring 50. The aforementioned effect of enhancing the bass range of music reduces when the hole 44 is closed, but the volume of sound leaking from the cup holes 17 also reduces if the number of the cup holes 17 exposed from the cutout portion 16B is 0 or 1. In other words, by adjusting whether to open or close the hole 44 with the O ring 50 according to the number of cup holes 17 exposed from the cutout portion 16C, it is possible to adjust the sound heard from the earpiece 10, for example, adjust the balance between the treble range and the bass range.

As illustrated in FIG. 6B, the earpiece 10 is worn in the left ear 31 of the user such that the cup holes 17 face the tragus 33 outside the ear canal 32 of the left ear 31 of the user. In addition, the hole 44 formed in the housing 41 is set to be located on the tragus 33 side outside the ear canal 32 of the left ear 31 of the user. In sum, when the earpiece 10 is worn, the cup holes 17 and the hole 44 are set to face in the same direction, that is, the side in front of the head of the user.

When the cup holes 17 and the hole 44 are set in the aforementioned same direction, a part of music is released from the hole 44, but a part of the released music is returned into the internal space 20 of the earpiece 10 through the cup holes 17. Then, the user can perceive the aforementioned returned music as the indirect sound having the time difference as described above, and thereby feel the out-of-head sound localization and sound spread, thereby experiencing a sense of direction from the front and realistic sensation.

Figure 7:
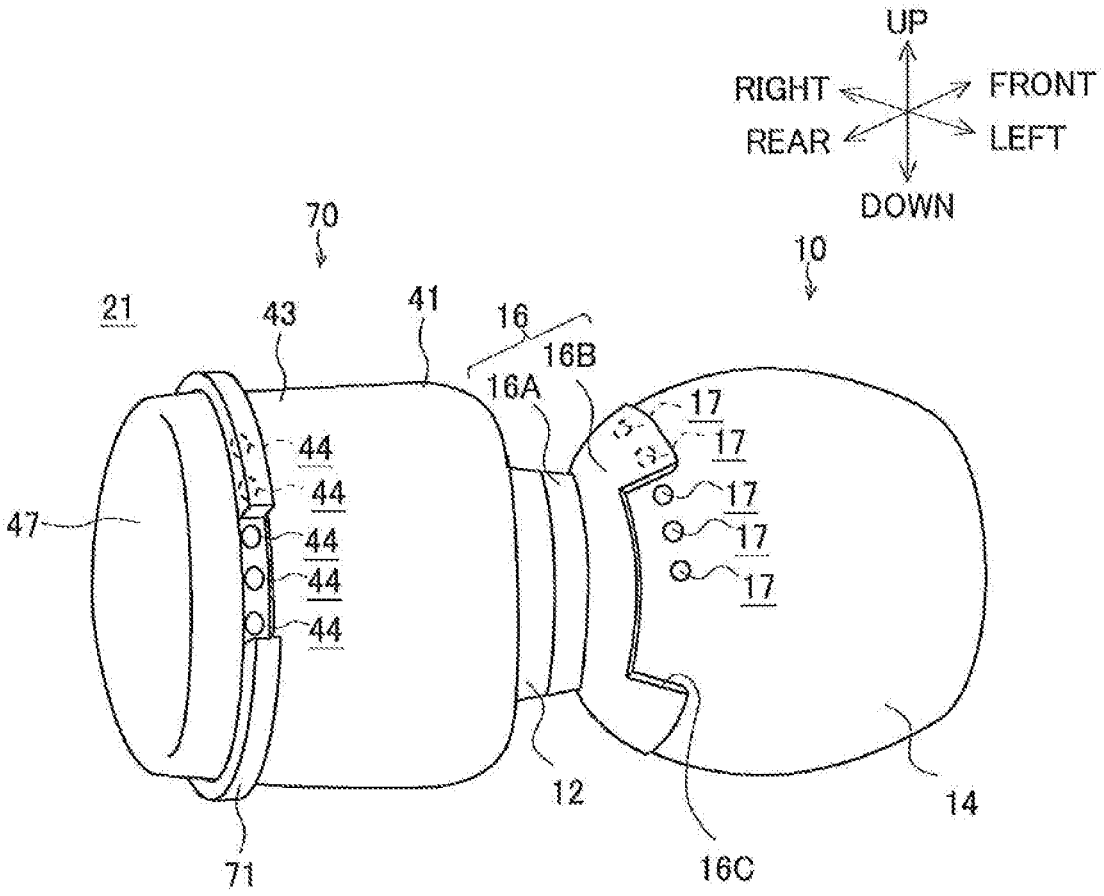
FIG. 7 is a perspective view for explaining the modification example of the earphone as the other embodiment of the present invention.
Figure 8:
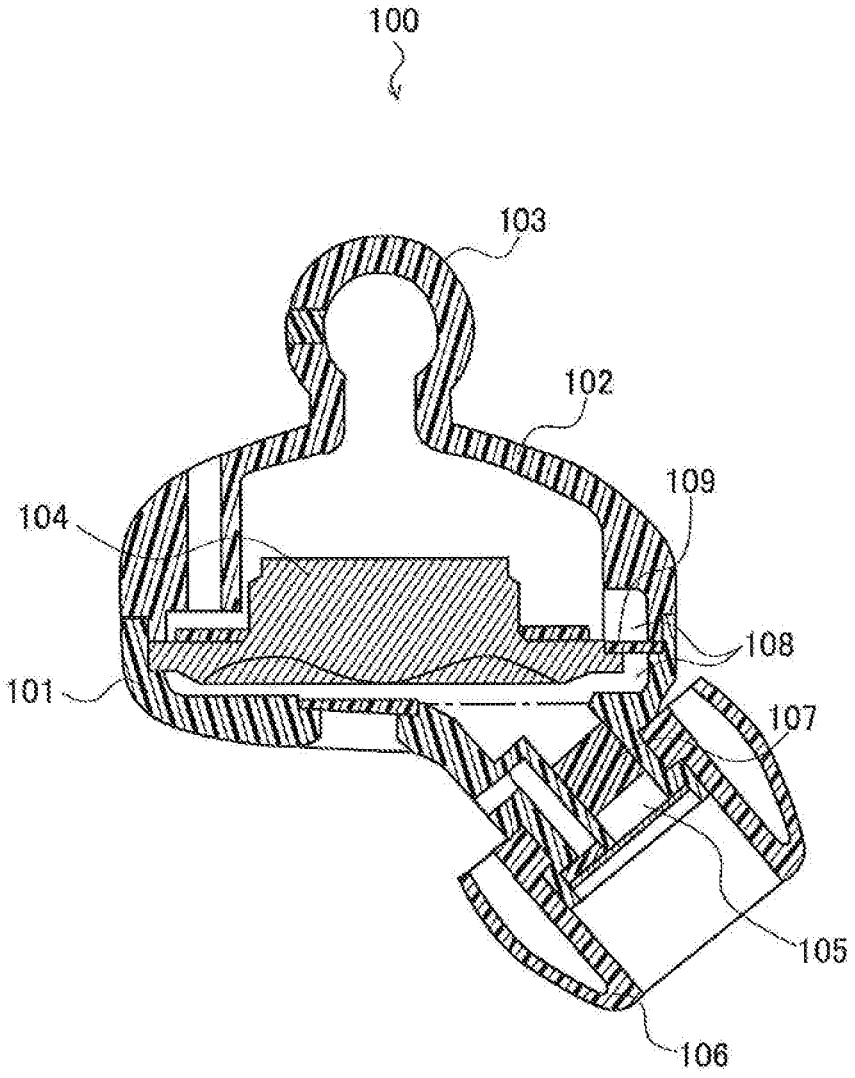
FIG. 8 is a cross-sectional view for explaining a structure of a conventional earphone.
Figure 9A:
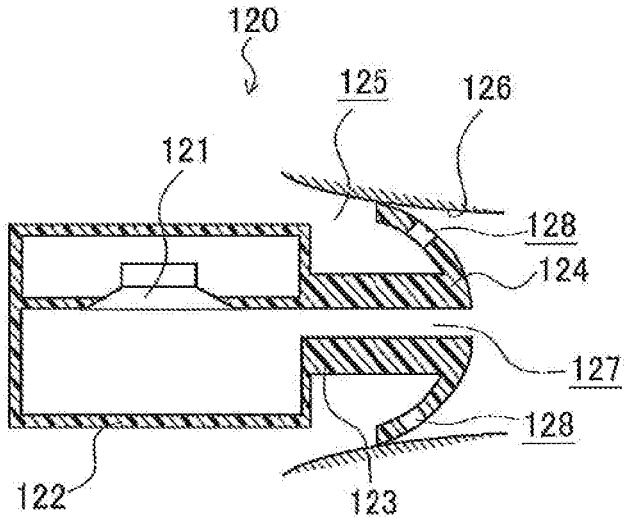
FIG. 9A is a cross-sectional view and FIG. 9B is a top view for explaining a structure of a conventional canal type earphone.
Figure 9B:
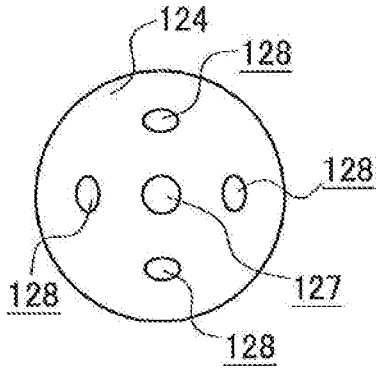

Here, FIG. 7 is a perspective view for explaining an earphone 70 of the present embodiment, and illustrates a modification example of the earphone 11 described by using FIGS. 6A and 6B. Then, the earphone 70 illustrated in FIG. 7 has a structure different from the aforementioned structure of the earphone 11 mainly in that an annular groove 48 is formed in the side surface 43 of the housing 41, multiple holes 44 are formed in the groove 48, and the number of holes 44 opened is adjustable by a slide ring 71 arranged in the groove 48. For this reason, in the description of the earphone 70 in FIG. 7, components different from those in the earphone 11 described using FIGS. 6A and 6B will be mainly explained, and the explanation of the other components will be made by reference.

As illustrated in FIG. 7, the annular groove 48 is formed on the side surface 43 of the housing 41, and, for example, five holes 44 are formed at regular intervals in the groove 48. The holes 44 are holes through which the internal space 46 (see FIGS. 6A and 6B) of the housing 41 and the external space 21 outside the housing 41 communicate with each other. Then, the holes 44 are formed in the housing 41 surrounding the internal space 46 between the driver unit 42 (see FIGS. 6A and 6B) and the bottom surface 47 of the housing 41. Note that, as described above, when the earpiece 10 is worn, the five holes 44 are located on the tragus 33 (see FIG. 6B) side of the user as in the case of the cup holes 17.

As illustrated in the drawing, the slide ring 71 is arranged in the groove 48 of the housing 41. The slide ring 71 has, for example, a C shape, and allows the holes 44 to be exposed from its opening portion. Then, the opening width of the slide ring 71 has a width enough to expose the aforementioned five holes 44 simultaneously. When the slide ring 71 slides while rotating in the groove 48, the number of exposed holes 44 can be changed within a range of 0 to 5.

The holes 44 exposed from the slide ring 71 release the pressure in the internal space 46 when the diaphragm of the driver unit 42 vibrates. Then, The bass range of music can be enhanced by widening the amplitude width of the diaphragm of the driver unit 42. Here, since the number of exposed holes 44 is adjustable, the earphone 70 does not have to include the hole 45 of the earphone 11 illustrated in FIGS. 6A and 6B in some cases.

As described above by using FIG. 1B, since the exposure of the cup holes 17 from the cutout portion 16C increases the volume of sound transmitted to the external space 21, the earpiece 10 tends to greatly reduce the bass range of music, in particular. To address this, the number of holes 44 exposed from the slide ring 71 is increased to increase the bass range transmitted to the earpiece 10 through the stem section 12. This compensates for the disadvantage in the case where many cup holes 17 are opened. As described above, the opening of many cup holes 17 is advantageous in that the user can feel the out-of-head sound localization and sound spread, thereby experiencing a sense of direction from the front and realistic sensation.

In sum, by adjusting the number of exposed cup holes 17 in the earpiece 10 and the number of exposed holes 44 in the housing 41 as appropriate according to preferences or the like, the user can adjust, for example, the balance between the treble range and the bass range, and also feel the out-of-head sound localization and sound spread, thereby experiencing a sense of direction from the front and realistic sensation. Further, the adjustment of the numbers of cup holes 17 and holes 44 enables the sound in the left ear and the sound in the right ear to be also merged mutually, so that the realistic sensation can be enhanced. The same effect can be obtained also by the earpiece 60 described using FIG. 4.

The present embodiment is described in the case where the spherical portion 15D of the plug section 15 is exposed from the central tube section 13 to the outside, but embodiments should not be limited to this case. For example, the plug section 15 may include only the cylindrical portion 15C, and the entire plug section 15 may be inserted in the sound channel space 13A of the central tube section 13. Also in this case, the aperture 15A of the plug section 15 is provided at the distal end of the cylindrical portion 15C, and a very small part of the sound transmitted from the stem section 12 is directly transmitted through the aperture 15A to the eardrum on the inner side of the ear canal 32. In addition, when the plug section 15 is housed in the central tube section 13, the plug section 15 hardly comes into contact with the ear canal 32 of the user when the earpiece 10 is worn, and the user is unlikely to feel unpleasant due to contact of the inner wall 34 with the plug section 15. In any other ways, various alternations may be made without departing from the gist of the present invention.

REFERENCE SIGNS LIST

10 earpiece
11 earphone
12 stem section
12B mount/demount groove
13 central tube section
13A sound channel space
13E sound channel hole
13H lock protrusion
14 cup section
15 plug section
15A aperture
15B sound channel long hole
15C cylindrical portion
15D spherical portion
15G sound channel short hole
16 cup hole adjuster plate
17 cup hole
20 internal space
21 external space
31 left ear
32 ear canal
33 tragus
34 inner wall
41 housing
44 hole

What is claimed is:

1. An earpiece detachably attached to a mount/demount groove of a stem section of an earphone, comprising:
- a central tube section, one end side of which is attached to the stem section, and which internally includes a sound channel space;
- a cup section which is provided to surround the central tube section, one end side of which is foniied integrally with the one end side of the central tube section, and the other end side of which is a free end; and
- a plug section, one end side of which is inserted in the sound channel space from the other end side of the central tube section, wherein
- a sound channel hole through which the sound channel space and an internal space inside the cup section communicate with each other is formed in the central tube section, and
- at least one cup hole through which the internal space and an external space outside the cup section communicate with each other is formed in the cup section near the stem section.

2. The earpiece according to claim 1, wherein
- the plug section includes a sound channel long hole penetrating through inside of the plug section in a longitudinal direction thereof, and a sound channel short hole communicating with the sound channel long hole and formed in a lateral direction of the plug section, and
- in a state where the plug section is inserted in the sound channel space, the sound channel hole, the sound channel long hole, and the sound channel short hole communicate with each other.

3. The earpiece according to claim 2, wherein
- the plug section is exposed from the other end side of the central tube section,
- an exposed portion of the plug section has a shape of a spherical body, and
- a width of an aperture formed by the sound channel long hole in the spherical body is narrower than a width of the sound channel long hole located inside the central tube section.

4. The earpiece according to claim 1, further comprising a cup hole adjuster plate arranged in abutment with an outer surface of the cup section, wherein
- the cup hole adjuster plate includes
  - a lock portion locked in the mount/demount groove, and
  - a plate portion formed integrally with the lock portion and covering a portion of the outer surface at least including a region in which the plurality of cup holes are arranged,
- a cutout portion from which the plurality of cup holes are exposed is formed in the plate portion, and
- the cutout portion has a width enough to expose all the plurality of cup holes.

5. The earpiece according to claim 4, wherein
- the number of the plurality of cup holes exposed from the cutout portion is adjustable by rotating one of the cup section and the cup hole adjuster plate relative to the stem section.

6. The earpiece according to claim 4, wherein
- a portion of the other end side of the central tube section is formed as a lock protrusion which protrudes toward the sound channel space,
- an engagement portion that is engaged with the lock protrusion is formed on the outer surface of the plug section, and
- in a state where the plug section is inserted in the sound channel space, the engagemieni portion is located closer to the stem section than the lock protrusion is.

7. An earphone to which the earpiece according to claim 1 is attached, comprising:
- a diaphragm which vibrates according to an electric signal;
- a housing in which the diaphragm is arranged; and
- a stem section which is formed on one end side of the housing and to which the earpiece is attached, wherein
- a side surface of the housing between an end of the housing on the other end side and the diaphragm is provided with at least one hole, and
- in a state where the earphone is worn in an ear of a user, the hole in the housing and the cup hole in the earpiece face a tragus side of the ear of the user.

8. An earphone to which the earpiece according to claim 1 is attached, comprising:
- diaphragm whith vibrates according to an electric signal;
- a housing in which the diaphragm is arranged; and
- a stem section which is formed on one end side of the housing and to which the earpiece is attached, wherein
- a plurality of holes are provided in and a slide ring which adjusts the mmiber of the holes exposed from the side surface of the housing is arranged on a side surface of the housing between an end of the housing on the other end side and the diaphragm, and in a state where the earphone is worn in an ear of a user, the holes in the housing and the cup hole in the earpiece face a tragus side of the ear of the user.

9. An earphone to which the earpiece according to claim 2 is attached, comprising:

a diaphragm which vibrates according to an electric signal;

a housing in which the diaphragm is arranged; and a stem section which is formed on one end side of the housing and to which the earpiece is attached, wherein a side surface of the housing between an end of the housing on the other end side and the diaphragm is provided with at least one hole, and in a state where the earphone is worn in an ear of a user, the hole in the housing and the cup hole in the earpiece face a tragus side of the ear of the user.

10. An earphone to which the earpiece according to claim 3 is attached, comprising:

a diaphragm which vibrates according to an electric signal;

a housing in which the diaphragm is arranged; and.

a stem section which is formed on one end side of the housing and to which the earpiece is attached, wherein a side surface of the housing between an end of the housing on the other end side and the diaphragm is provided with at least one hole, and in a state where the earphone is worn in an ear of a user, the hole in the housing and, the cup hole in the earpiece face a tragus side of the ear of the user.

11. An earphone to which the earpiece according to claim 4 is attached, comprising:

a diaphragm which vibrates according to an electric signal;

a housing in which the diaphragm is arranged; and a stem section which is formed on one end side of the housing and to which the earpiece is attached, wherein a side surface of the housing between an end of the housing on the other end side and the diaphragm is provided with at least one hole, and in a state where the earphone is worn in an ear of a user, the hole in the housing and the cup hole in the earpiece face a tragus side of the ear of the user.

12. An earphone to which the earpiece according to claim 5 is attached, comprising:

a diaphragm which vibrates according to an electric signal;

a housing in which the diaphragm is arranged; and a stem section which is formed on one end side of the housing and to which the earpiece is attached, wherein a side surface of the housing between an end of the housing on the other end side and the diaphragm is provided with at least one hole, and in a state where the earphone is worn in an ear of a user, the hole in the housing and the cup hole in the earpiece face a tragus side of the ear of the user.

13. An earphone to which the earpiece according to claim 6 is attached, comprising:

a diaphragm which vibrates according to an electric signal;

a housing in which the diaphragm is arranged; and a stem section which is formed on one end side of the housing and to which the earpiece is attached, wherein a side surface of the housing between an end of the housing on the other end side and the diaphragm is provided with at least one hole, and in a state where the earphone is worn in an ear of a user, the hole in the housing and the cup hole in the earpiece face a tragus side of the ear of the user.

14. An earphone to which the earpiece according to claim 2 is attached, comprising:

a diaphragm which vibrates according to an electric signal;

a housing in which the diaphragm is arranged; and a stem section which is formed on one end side of the housing and to which the earpiece is attached, wherein a plurality of holes are provided in and a slide ring which adjusts the number of the holes exposed from the side surface of the housing is arranged on a side surface of the housing between an end of the housing on the other end side and the diaphragm, and in a state where the earphone is worn in an ear of a user, the holes in the housing and the cup hole in the earpiece face a tragus side of the ear of the user.

15. An earphone to which the eamiece according to claim 3 is attached, comprising:

a diaphragm which vibrates according to an electric signal;

a housing in which the diaphragm is arranged; and a stem section which is formed on one end side of the housing and to which the earpiece is attached, wherein a plurality of holes are provided in and a slide ring which adjusts the number of the holes exposed from the side surface of the housing is arranged on a side surface of the housing between an end of the housing on the other end side and the diaphragm, and in a state where the earphone is worn in an ear of a user, the holes in the housing and the cup hole in the earpiece face a tragus side of the ear of the user.

16. An earphone to which the earpiece according to claim 4 is attached, comprising:

a diaphragm which vibrates according to an electric signal;

a housing in which the diaphragm is arranged; and a stem section which is formed ori one end side of the housing and to which the earpiece is attached, wherein a plurality of holes are provided in and a slide ring which adjusts the number of the holes exposed from the side surface of the housing is arranged on a side surface of the housing between an end of the housing on the other end side and the diaphragm, and in a state where the earphone is worn in an ear of a user, the holes in the housing and the cup hole in the earpiece face a traps side of the ear of the user.

17. An earphone to which the earpiece according to claim 5 is attached, comprising:

a diaphragm which vibrates according to an electric signal, a housing in which the diaphragm is arranged; and a stem section which is formed on one end side of the housing and to which the earpiece is attached, wherein a plurality of holes are provided in and a slide ring which adjusts the number of the holes exposed from the side surface of the housing is arranged on a side surface of the housing between an end of the housing on the other end side and the diaphragm, and in a state where the earphone is worn in an ear of a user, the holes in the housing and the cup hole in the earpiece face a tragus side of the ear of the user.

18. An earphone to which the earpiece according to claim 6 is attached, comprising:

a diaphragm which vibrates according to an electric signal;

a housing in which the diaphragm is arranged; and a stem section which is formed on one end side of the housing and to which the earpiece is attached, wherein a plurality of holes are provided in and a slide ring which adjusts the number of the holes exposed from the side surface of the housing is arranged on a side surface of the housing between an end of the housing on the other end side and the diaphragm, and in a state where the earphone is worn in an ear of a user, the holes in the housing and the cup hole in the earpiece face a tragus side of the ear of the user.

* * * * *